US011987948B2

(12) United States Patent
He et al.

(10) Patent No.: US 11,987,948 B2
(45) Date of Patent: May 21, 2024

(54) PUMPING METHOD OF LARGE-DIAMETER HORIZONTAL PRESSURIZED LONG DEWATERING WELL FOR INEXHAUSTIBLE PUMPING STRATA

(71) Applicants: Sinoma Geological Engineering Exploration and Research Institute Co., Beijing (CN); Beijing Building Materials and Geological Engineering Co., Beijing (CN); Beijing City Construction Technology Promotion Association, Beijing (CN)

(72) Inventors: Shiming He, Beijing (CN); Dangsheng Guo, Beijing (CN); Jiang Li, Beijing (CN); Fengchen Yang, Beijing (CN); Yucheng Zhou, Beijing (CN); Hekun Yu, Beijing (CN); Hui Chen, Beijing (CN); Xinfeng Huang, Beijing (CN); Chenghua Liang, Beijing (CN); He Huang, Beijing (CN)

(73) Assignees: SINOMA GEOLOGICAL ENGINEERING EXPLORATION AND RESEARCH INSTITUTE CO., Beijing (CN); BEIJING BUILDING MATERIALS AND GEOLOGICAL ENGINEERING CO., Beijing (CN); BEIJING CITY CONSTRUCTION TECHNOLOGY PROMOTION ASSOCIATION, Beijing (CN)

( * ) Notice: Subject to any disclaimer, the term of this patent is extended or adjusted under 35 U.S.C. 154(b) by 108 days.

(21) Appl. No.: 17/717,819

(22) Filed: Apr. 11, 2022

(65) Prior Publication Data

US 2022/0396927 A1 Dec. 15, 2022

(30) Foreign Application Priority Data

Jun. 11, 2021 (CN) ..... 202110657097.3

(51) Int. Cl.
*E02D 31/00* (2006.01)
*E02D 31/02* (2006.01)

(52) U.S. Cl.
CPC ..... *E02D 31/02* (2013.01)

(58) Field of Classification Search
CPC ..... E02D 31/02; E02D 17/04; E02D 19/10; E02D 19/06
See application file for complete search history.

(56) References Cited

U.S. PATENT DOCUMENTS

2018/0230665 A1* 8/2018 Niroumand ..... E21B 43/04

FOREIGN PATENT DOCUMENTS

CN 104727318 * 6/2015
CN 104790419 * 7/2015
(Continued)

*Primary Examiner* — Carib A Oquendo
(74) *Attorney, Agent, or Firm* — Rachel Pilloff; Sean Passino; Martin Cosenza

(57) ABSTRACT

Disclosed is a pumping method of a large-diameter horizontal pressurized long dewatering well for inexhaustible pumping strata. Clay layers and sand soil layers are determined according to construction positions of foundation pits, horizontal holes are drilled in the sand soil layers with a drill rig with simultaneous casing, and after the designed depth is reached, horizontal wells are placed, the horizontal wells are located above the junction of the clay layers and the sand soil layers, and the horizontal wells comprise drain pipes and air ducts, the drain pipes and the air ducts are located at the same elevation, each air duct is located between the two drain pipes, and the air duct is connected with the air pipe of the air compressor to deliver and pressurize, so as to facilitate water in the strata of aquifer to gather into the drain pipes.

3 Claims, 2 Drawing Sheets

(56) References Cited

FOREIGN PATENT DOCUMENTS

| | | | |
|---|---|---|---|
| CN | 207919564 | * | 9/2018 |
| CN | 21411667 | * | 9/2021 |

* cited by examiner

PUMPING METHOD OF LARGE-DIAMETER HORIZONTAL PRESSURIZED LONG DEWATERING WELL FOR INEXHAUSTIBLE PUMPING STRATA

CROSS-REFERENCE TO RELATED APPLICATIONS

This application claims priority to Chinese Patent Application No. 202110657097.3, filed on Jun. 11, 2021, the contents of which are hereby incorporated by reference.

TECHNICAL FIELD

The application relates to a pumping method of a large-diameter horizontal pressurized long dewatering well for inexhaustible pumping strata.

BACKGROUND

At present the foundation pit in most construction projects mostly adopts the light well point and tube well dewatering method in north China, for example Beijing. Because the light well point is no longer applicable in the water-rich strata of a deep and large foundation pit, the tube well dewatering is almost "the only choice", which seems to be a universal dewatering method. However, poor design, construction and maintenance of dewatering wells lead to unsatisfactory foundation pit dewatering, even failure of anchor rods or composite soil nailing walls, failure of supporting system, damage to surrounding environment, crack or even collapse of surrounding buildings and structures, which are severe consequences. For example, in the foundation pit of Beijing Jing'ao Building, the composite soil nailing wall performed poor deformation control due to poor dewatering effects, which causes that the 16-story residential building on the east side only was equipped with the elevator to the $15^{th}$ floor at most, which was later identified as a dilapidated building. The 6-story residential building on the south side was suspended after the foundation pit collapsed, so residents could not get inside, and at last the two residential buildings were both demolished. For another example, in the case of the basement of Beijing Jiuzhang Building, the foundation pit was supported by piles and anchors, and the dewatering well was arranged between two slope piles due to site space restrictions, which failed to control groundwater. The foundation pit collapsed after a heavy rain, and the six-story residential building on the south side collapsed, so that residents could not go inside, and were arranged in hotels. Finally, the whole basement with finished floors was filled, and the basement was terminated. The design, construction and maintenance of the dewatering well is also one of the causes of the accident. Such cases can be seen everywhere.

Especially when there is interbedded soil of sand soil layer or sand pebble layer and clay soil layer, the tube well dewatering is poorer. Because clay soil layer supports aquifer, the tube well dewatering effect is poor, and the water level of pumping well is very low, but there is still a lot of water on the slope, which not only brings trouble to the construction of supporting excavation, but also takes time and efforts to form holes with a soil nailing anchor, and the bearing capacity is greatly impaired. Water draining in the pit is the only choice when earthwork is excavated and transported, and sometimes "mud" is the thing to be transported and negatively affects the surrounding environment of the foundation pit, which is commonly known as "inexhaustible pumping strata". At present, the general practice is to insert drain pipes on the slopes, drill holes of 0.5-1.0 m with Luoyang shovel or drill rig, place a plastic pipe and fill the pipe with some stone chips. This practice is sometimes effective when there is very little water, only "addressing the symptoms instead of causes" in most cases, and makes extremely limited contribution or even proves almost ineffective.

SUMMARY

The application proposes a pumping method of a large-diameter horizontal pressurized long dewatering well for inexhaustible pumping strata, has advantages of accurate positioning, strong pertinence and quick effects, and can alleviate the settlement deformation of the environment around the foundation pit caused by holes drilling and water drainage.

In order to achieve the above objective, the technical scheme adopted by the application is as follows:

a pumping method of a large-diameter horizontal pressurized long dewatering well for inexhaustible pumping strata, including the following steps:

S1: excavating a side wall of a foundation pit by determining an accurate position according to an investigation report and a site, and determining the positions of each clay layer and sand soil layer according to the construction position of the foundation pit;

S2: putting a drilling rig with simultaneous casing, a water pump, an air compressor and other equipment in place, and installing and debugging;

S3: measuring and setting-out for positioning holes and locating horizontal position at a junction of inexhaustible pumping strata; carrying out horizontal drilling in the sand soil layers containing an aquifer by using the drilling rig with simultaneous casing, and after reaching the designed depth, drawing out the inner pipe, placing horizontal wells, and then drawing out the casing; situating the horizontal wells above the junction of the clay layers and the sand soil layers, so that the whole horizontal wells including the drain pipes and the air ducts is in the aquifer; sealing around openings of the drain pipes and the air ducts in the radial direction of 10 cm-20 cm;

S4: corresponding the horizontal wells to upper row of soil nails or anchors; with soil nails or prestressed anchor cables already arranged in the clay layers of the side wall of the foundation pit, getting the horizontal wells longitudinally aligned with the soil nails or prestressed anchor cables on the side wall of the foundation pit, and getting the depth of the horizontal wells equal to the length of the soil nails or prestressed anchor cables, so that the bearing capacity is not reduced due to the reduction of the side friction because of the high water content of the soil layer within the full length of the soil nails or the prestressed anchor cables;

S5: arranging a pressurized air duct in the middle of every two long wells, so as to ensure that the air ducts are in the aquifer, getting the drain pipes and the air ducts at the same elevation; getting each air duct between drain pipes, to make air ducts in the aquifer;

S6: carrying out construction work on horizontal wells and pressurized holes according to design requirements;

S7: carrying out construction work on pressurized holes according to design requirements; and S8: connecting an air compressor and the pressurized air ducts to inflate and pressurize, discharging long horizontal wells' water into a collecting ditch, gathering water in a collecting well for pumping out and draining; connecting the air ducts with the air pipe of the air compressor through a reducing joint, so as to inflate and pressurize the aquifer, which facilitates the water in the aquifer to flow to the drain pipes more quickly; discharging the water into collecting ditch by the drain pipes, gathering the water in the collecting well and pumping out the water to ensure the dry operation in the base tank, and contribute to controlling the settlement deformation of surrounding environment as well, because the pressurization of air can counteract part of the settlement deformation.

For the pumping method of a large-diameter horizontal pressurized long dewatering well for inexhaustible pumping strata, the drain pipes are made of polyvinyl chloride (PVC) hard plastic, the water inlet holes on the drain pipes are distributed in pentagon shape, and the outer wall and two ends of the drain pipes are wrapped with a double-layer dense mesh of 60 mesh, and the drain pipes are filled with stones or stone chips to ensure that only water can be discharged instead of sand and gravel.

For the pumping method of a large-diameter horizontal pressurized long dewatering well for inexhaustible pumping strata, the air ducts are also made of polyvinyl chloride (PVC) hard plastic; only 1/10 of a total length of a bottom end of the air ducts is provided with 2-3 rows of exhaust holes, which are distributed circumferentially, the outer wall and two ends of the air ducts are wrapped with double-layer dense mesh of 60 meshes, the inside is hollow and the air ducts are connected with the air pipe of the air compressor through a reducing joint.

The application has the advantages below:

(1) The method is precise and targeted: the positions of horizontal long wells and pressurized air wells are accurately determined through site excavation of the side wall of foundation pit combined with geological survey report, so that good accuracy of drilling horizontal wells for "inexhaustible pumping" strata is ensured.

(2) The method is quick-acting: by making full use of the advantage that the horizontal permeability coefficient is far greater than the vertical permeability coefficient, the water in the aquifer strata is quickly discharged, and the "inexhaustible pumping strata" is turned into a dewatering strata.

(3) The bearing capacity of the soil nail anchor is guaranteed. As the horizontal long well is as long as the upper row of soil nails or anchor rods, the water within the whole length of the soil nail or anchor rod is ensured to be discharged, and the side friction resistance is not affected, so that the bearing capacity of the soil nail or anchor rod is not affected.

(4) The pressurized air wells have dual functions. In addition to pressurizing the water in the aquifer to flow to the horizontal long well as soon as possible, it can also alleviate the influence of holes drilling and water-discharging on the settlement deformation of the surrounding environment of the foundation pit.

DETAILED DESCRIPTION OF THE EMBODIMENTS

Figure 1:
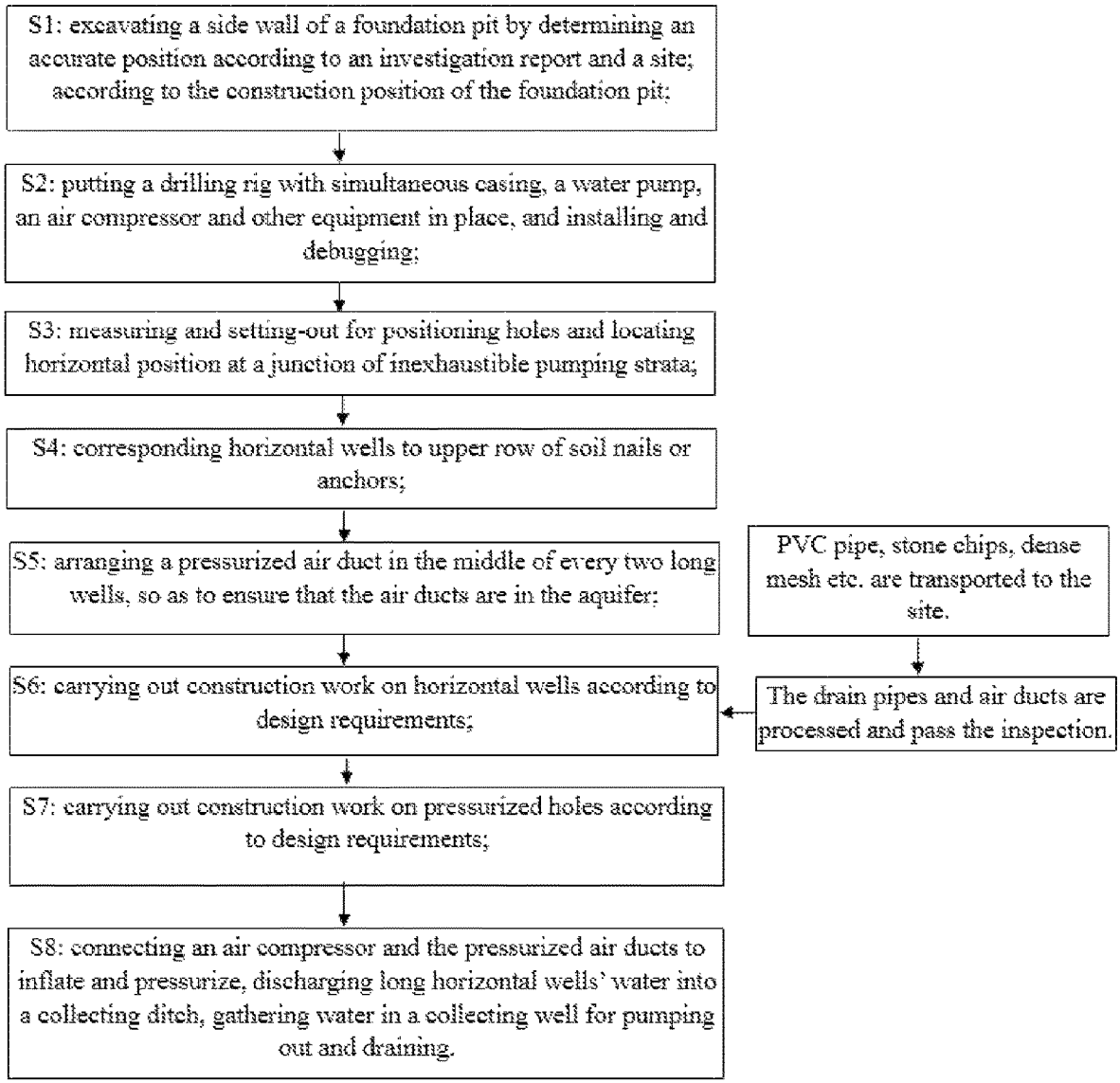
FIG. 1 is a flowchart of a pumping method of a large-diameter horizontal pressurized long dewatering well for inexhaustible pumping strata.
Figure 2:
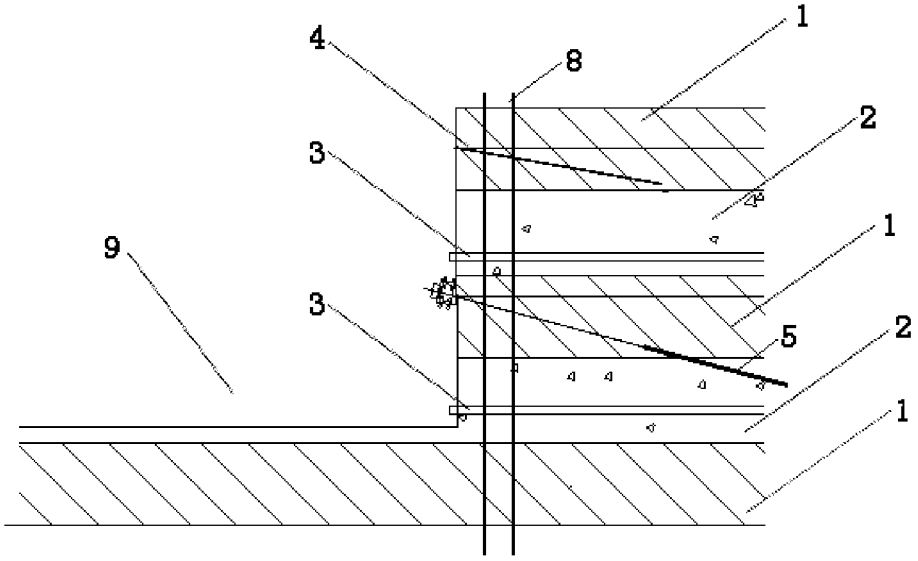
FIG. 2 is a sectional structure diagram of a pumping method of a large-diameter horizontal pressurized long dewatering well for inexhaustible pumping strata.
Figure 3:
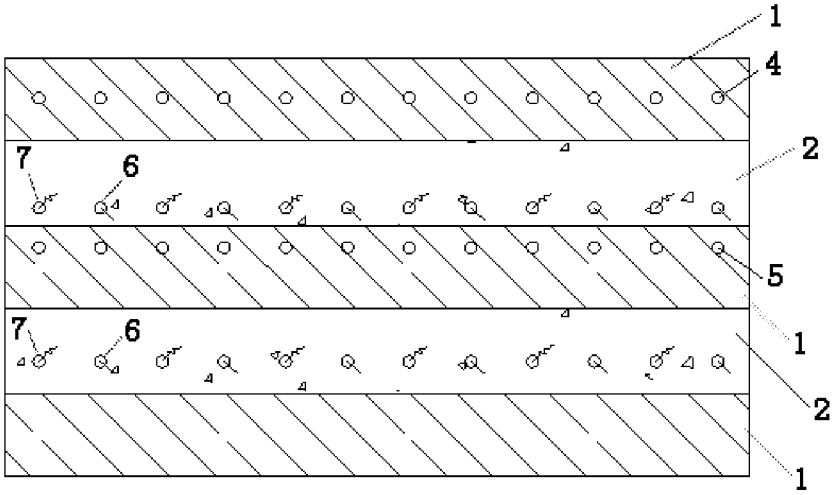
FIG. 3 is another sectional structure diagram of a pumping method of a large-diameter horizontal pressurized long dewatering well for inexhaustible pumping strata.

As shown in FIG. 1-FIG. 3, a pumping method of a large-diameter horizontal pressurized long dewatering well for inexhaustible pumping strata includes the following steps:

S1: excavating a side wall of a foundation pit 9 by determining an accurate position according to an investigation report and a site, and determining the positions of each clay layer 1 and sand soil layer 2 according to the construction position of the foundation pit 9;

S2: putting a drilling rig with simultaneous casing, a water pump, an air compressor and other equipment in place, and installing and debugging;

S3: measuring and setting-out for positioning holes and locating horizontal position at a junction of inexhaustible pumping strata; carrying out horizontal drilling in the sand soil layers 2 containing an aquifer by using the drilling rig with simultaneous casing, and after reaching the designed depth, drawing out the inner pipe, placing horizontal wells 3, and then drawing out the casing; situating the horizontal wells 3 above the junction of the clay layers 1 and the sand soil layers 2, so that the whole horizontal wells 3 including the drain pipes 6 and the air ducts 7 is in the aquifer; sealing around openings of the drain pipes 6 and the air ducts 7 in radial direction of 10 cm-20 cm;

S4: corresponding the horizontal wells to upper row of soil nails 4 or anchors; with soil nails 4 or prestressed anchor cables 5 already arranged in the clay layers 1 of the side wall of the foundation pit 9, getting the horizontal wells 3 longitudinally aligned with the soil nails 4 or prestressed anchor cables 5 on the side wall of the foundation pit 9, and getting the depth of the horizontal wells 3 equal to the length of the soil nails 4 or prestressed anchor cables 5, so that the bearing capacity is not reduced due to the reduction of the side friction because of the high water content of the soil layer within the full length of the soil nails 4 or the prestressed anchor cables 5;

S5: arranging a pressurized air duct in the middle of every two long wells, so as to ensure that the air ducts 7 bare in the aquifer, getting the drain pipes 6 and the air ducts 7 at the same elevation; getting each air duct 7 between drain pipes 6, to make air ducts 7 in the aquifer;

S6: carrying out construction work on horizontal wells according to design requirements; at the same time of horizontal wells' construction, transporting PVC pipes, stone chips, dense nets, etc. into a site to process drain pipes and air ducts 7, and meanwhile, conducting qualification inspection on them;

S7: carrying out construction work on pressurized holes according to design requirements; and S8: connecting an air compressor and the pressurized air ducts to inflate and pressurize, discharging long horizontal wells' water into a collecting ditch, gathering water in a collecting well for pumping out and draining; connecting the air ducts 7 with the air pipe of the air compressor through a reducing joint, so as to inflate and pressurize the aquifer, which facilitates the water in the aquifer to flow to the drain pipes 6 more quickly; discharging the water into the collecting ditch by the drain pipes 6, gathering the water in the collecting well and pumping out the water to ensure the dry operation in the base tank, and contribute to controlling the settlement deformation of surrounding environment as well, because the pressurization of air can counteract part of the settlement deformation.

The drain pipes are made of polyvinyl chloride (PVC) hard plastic, the water inlet holes on the drain pipes are distributed in pentagon shape, and the outer wall and two ends of the drain pipes are wrapped with a double-layer dense mesh of 60 mesh, and the drain pipes are filled with stones or stone chips to ensure that only water can be discharged instead of sand and gravel.

The air ducts are also made of polyvinyl chloride (PVC) hard plastic; only 1/10 of a total length of the bottom end of the air ducts is provided with 2-3 rows of exhaust holes, which are distributed circumferentially, the outer wall and two ends of the air ducts are wrapped with double-layer dense mesh of 60 meshes, and hollow inside and the air ducts are connected with the air pipe of the air compressor through a reducing joint.

Embodiments

According to the construction position of the foundation pit 9, the side wall is excavated, and the accurate positions of each clay layer 1 and the sand soil layer 2 are determined by exploration and positioning, and the sand soil layer 2 contain an aquifer.

The drilling rig with simultaneous casing, water pump, air compressor and other equipment are put in place, and installed and debugged. Measuring and arranging positioning holes are carried out at the position of little above the junction of the clay layers 1 and the sand soil layers 2 for accurately inserting the horizontal wells 3 in the future. Soil nails 4 or prestressed anchor cables 5 have been arranged in the clay layer 1 on the side wall of the foundation pit 9. The insertion position of the horizontal wells 3 is longitudinally aligned with the soil nails 4 or prestressed anchor cables 5. The depth of the horizontal wells 3 is the same as the length of the soil nails 4 or prestressed anchor cables 5.

The horizontal wells 3 include the drain pipes 6 and the air ducts 7. The drain pipes are made of PVC hard plastic, and the water inlet holes on the drain pipes are arranged in a pentagon shape. The outer wall and two ends of the drain pipes are wrapped with double-layer 60-mesh mesh. The drain pipes are filled with stones or stone chips to ensure that only water instead of sand and gravel comes out. The air ducts are also made of PVC hard plastic, and only 1/10 of a total length of a bottom end is provided with 2-3 rows of exhaust holes which are distributed circumferentially. The outer wall and two ends of the air ducts are wrapped with double-layer dense mesh of 60 mesh, and the air duct is hollow inside. The water drain pipes 6 and the air ducts 7 are processed as described above and pass the inspection, and enter the site for further construction.

The drilling rig with simultaneous casing performs horizontal drilling on the positioning holes, after the drilling rig reaches the designed depth, the inner pipe is extracted, the drain pipes 6 and the air ducts 7 are inserted, and then the casing is extracted. The drain pipes 6 and the air ducts 7 are located at the same elevation, and each air duct 7 is located between two drain pipes 6 to ensure that the air ducts 7 are in the aquifer, and the air ducts 7 are connected with the air pipe of the air compressor through a reducing joint.

The air ducts are connected with the air pipe of the air compressor through the reducing joint, and the aquifer is inflated and pressurized, so that the water in the aquifer strata can be gathered into the drain pipes 6 more quickly, and the water is discharged by the drain pipes 6 into the water collecting ditch, gathered in the water collecting well and pumped out by the water pump, thus ensuring the dry operation in the base tank. Meanwhile, because the pressurization of air can counteract part of the settlement deformation, it is beneficial to control the settlement deformation of the surrounding environment.

The advantages are as follows:

(1) The method is precise and targeted: the positions of horizontal long wells and pressurized air wells are accurately determined through site excavation of the side wall of foundation pit combined with geological survey report, so that good accuracy of drilling horizontal wells for "inexhaustible pumping" strata is ensured.

(2) The method is quick-acting: by making full use of the advantage that the horizontal permeability coefficient is far greater than the vertical permeability coefficient, the water in the aquifer strata is quickly discharged, and the "inexhaustible pumping strata" is turned into dewatering strata.

(3) The bearing capacity of the soil nail anchor is guaranteed. As the horizontal long well is as long as the upper row of soil nails or anchor rods, the water within the whole length of the soil nail or anchor rod is ensured to be discharged, and the side friction resistance is not affected, so that the bearing capacity of the soil nail or anchor rod is not affected.

(4) The pressurized air wells have dual functions: alleviating the influence of holes drilling and water-discharging on the settlement deformation of the surrounding environment of the foundation pit in addition to pressurizing the water in the aquifer to flow to the horizontal long well as soon as possible.

The above description is only illustrative, not restrictive. It should be understood by those skilled in the field that many modifications, changes or equivalents can be made without departing from the spirit and scope of the claims, but they will all fall within the scope of protection of the present application.

What is claimed is:

1. A pumping method of a large-diameter horizontal pressurized long dewatering well for inexhaustible pumping strata, comprising the following steps:

S1: excavating a side wall of a foundation pit by determining an accurate position according to an investigation report and a site, and determining positions of each clay layer and sand soil layer according to a construction position of the foundation pit;

S2: putting a drilling rig with simultaneous casing, a water pump, an air compressor and other equipment in place, installing and debugging;

S3: measuring and setting-out for positioning holes and locating a horizontal position at a junction of the clay layer and the sand soil layer; carrying out horizontal drilling in sand soil layers containing an aquifer by using the drilling rig with simultaneous casing, and after reaching a designed depth, drawing out an inner pipe, placing horizontal wells, and then drawing out a casing; situating the horizontal wells above a junction of clay layers and the sand soil layers, so that all the horizontal wells including drain pipes and air ducts are completely in the aquifer; sealing around openings of the drain pipes and the air ducts in a radial direction of 10 cm-20 cm;

S4: corresponding the horizontal wells to an upper row of soil nails or anchors; with soil nails or prestressed anchor cables already arranged in the clay layers of the side wall of the foundation pit, getting the horizontal wells longitudinally aligned with the soil nails or prestressed anchor cables on the side wall of the foundation pit, and getting a depth of the horizontal wells equal to a length of the soil nails or prestressed anchor cables, so that a bearing capacity is not reduced;

S5: arranging one of the air ducts in the middle of every two long wells, so as to ensure that the air ducts bare in the aquifer, getting the drain pipes and the air ducts at the same elevation; getting each air duct between the drain pipes, to make the air ducts in the aquifer;

S6: carrying out construction work on the horizontal wells;

S7: carrying out the construction work on pressurized holes;

S8: connecting the air compressor and the air ducts to inflate and pressurize, discharging water in long horizontal wells into a collecting ditch, gathering water in a collecting well for pumping out and draining; connecting the air ducts with an air pipe of the air compressor through a reducing joint, so as to inflate and pressurize the aquifer; discharging the water into the collecting ditch by the drain pipes, gathering the water in the collecting well and pumping out the water to ensure a dry operation in the foundation pit, and contribute to controlling the settlement deformation of surrounding environment.

2. The pumping method according to claim 1, wherein the drain pipes are made of polyvinyl chloride (PVC) hard plastic, water inlet holes on the drain pipes are distributed in a pentagon shape, an outer wall and two ends of the drain pipes are wrapped with a double-layer dense mesh of 60 meshes, and the drain pipes are filled with stones or stone chips to ensure that only water instead of sand and gravel is discharged.

3. The pumping method according to claim 1, wherein the air ducts are made of polyvinyl chloride (PVC) hard plastic, and only 1/10 of a total length of a bottom end is provided with 2-3 rows of exhaust holes, which are distributed circumferentially; an outer wall and two ends of the air ducts are wrapped with double-layer dense mesh of 60 meshes, the air ducts are hollow inside, and the air ducts are connected with the air pipe of the air compressor through the reducing joint.

* * * * *